US008241490B2

(12) United States Patent
Litz et al.

(10) Patent No.: US 8,241,490 B2
(45) Date of Patent: Aug. 14, 2012

(54) METHODS FOR UPGRADING OF CONTAMINATED HYDROCARBON STREAMS

(75) Inventors: Kyle E. Litz, Ballston Spa, NY (US); Jennifer L. Vreeland, Troy, NY (US); Jonathan P. Rankin, Troy, NY (US); Mark N. Rossetti, Castleton, NY (US); Tracey M. Jordan, Valley Falls, NY (US)

(73) Assignee: Auterra, Inc., Malta, NY (US)

( * ) Notice: Subject to any disclaimer, the term of this patent is extended or adjusted under 35 U.S.C. 154(b) by 36 days.

(21) Appl. No.: 12/904,446

(22) Filed: Oct. 14, 2010

(65) Prior Publication Data

US 2011/0031164 A1 Feb. 10, 2011

Related U.S. Application Data

(63) Continuation-in-part of application No. 12/888,049, filed on Sep. 22, 2010, and a continuation-in-part of application No. 12/933,898, filed as application No. PCT/US2008/082095 on Oct. 31, 2008.

(60) Provisional application No. 61/039,619, filed on Mar. 26, 2008.

(51) Int. Cl.
*C10G 17/04* (2006.01)

(52) U.S. Cl. ..... 208/208 R; 208/254 R; 208/273; 208/238; 208/219; 208/220; 208/222; 208/223; 208/282

(58) Field of Classification Search ..... None
See application file for complete search history.

(56) References Cited

U.S. PATENT DOCUMENTS

| | | | | |
|---|---|---|---|---|
| 2,764,525 | A | 9/1956 | Porter et al. | |
| 2,910,434 | A | 10/1959 | Hess et al. | |
| 2,987,470 | A | 6/1961 | Turken | |
| 3,505,210 | A * | 4/1970 | Heimlich et al. | 208/228 |
| 3,565,793 | A | 2/1971 | Herbstman et al. | |
| 3,668,117 | A | 6/1972 | Patel et al. | |
| 3,819,509 | A | 6/1974 | Wolk et al. | |
| 3,964,995 | A | 6/1976 | Wolk et al. | |
| 4,192,736 | A | 3/1980 | Kluksdahl | |
| 4,374,949 | A | 2/1983 | Massey et al. | |
| 4,444,655 | A | 4/1984 | Shiroto et al. | |
| 4,645,589 | A | 2/1987 | Krambeck et al. | |

(Continued)

FOREIGN PATENT DOCUMENTS

WO 2009120238 A1 10/2009

OTHER PUBLICATIONS

Application No. PCT/US08/82095, International Search Report and the Written Opinion of the International Searching Authority, or the Declaration dated Mar. 20, 2009. 12 pages.

(Continued)

*Primary Examiner* — Tam M Nguyen
(74) *Attorney, Agent, or Firm* — Schmeiser, Olsen & Watts, LLP

(57) ABSTRACT

A method of upgrading a heteroatom-containing hydrocarbon feed by removing heteroatom contaminants is disclosed. The method includes contacting the heteroatom-containing hydrocarbon feed with an oxidant to oxidize the heteroatoms, contacting the oxidized-heteroatom-containing hydrocarbon feed with caustic and a selectivity promoter, and removing the heteroatom contaminants from the heteroatom-containing hydrocarbon feed. The oxidant may be used in the presence of a catalyst.

18 Claims, 5 Drawing Sheets

U.S. PATENT DOCUMENTS

| | | | | |
|---|---|---|---|---|
| 5,637,739 | A | 6/1997 | Jacobsen et al. | |
| 6,160,193 | A | 12/2000 | Gore | |
| 6,245,223 | B1 | 6/2001 | Gorbaty et al. | |
| 6,368,495 | B1 | 4/2002 | Kocal et al. | |
| 6,403,526 | B1 | 6/2002 | Lussier et al. | |
| 6,406,616 | B1 * | 6/2002 | Rappas et al. | 208/240 |
| 6,544,409 | B2 * | 4/2003 | De Souza | 208/208 R |
| 6,673,236 | B2 | 1/2004 | Stanciulescu et al. | |
| 6,846,406 | B2 | 1/2005 | Canos et al. | |
| 7,144,499 | B2 | 12/2006 | Han et al. | |
| 7,153,414 | B2 * | 12/2006 | De Souza | 208/208 R |
| 7,179,368 | B2 | 2/2007 | Rabion et al. | |
| 7,314,545 | B2 | 1/2008 | Karas et al. | |
| 7,371,318 | B2 | 5/2008 | Corma Canos et al. | |
| 7,374,666 | B2 | 5/2008 | Wachs | |
| 7,790,021 | B2 * | 9/2010 | Kocal et al. | 208/230 |
| 7,875,185 | B2 * | 1/2011 | Zhang | 210/668 |
| 2004/0108252 | A1 * | 6/2004 | De Souza | 208/208 R |
| 2004/0178121 | A1 | 9/2004 | Leyshon et al. | |
| 2004/0222134 | A1 * | 11/2004 | de Souza | 208/237 |
| 2006/0011510 | A1 | 1/2006 | Toshima et al. | |
| 2006/0180501 | A1 | 8/2006 | Da Silva et al. | |
| 2008/0121565 | A1 | 5/2008 | Yoo et al. | |
| 2008/0308463 | A1 | 12/2008 | Keckler et al. | |
| 2009/0065399 | A1 | 3/2009 | Kocal et al. | |
| 2011/0011771 | A1 | 1/2011 | Litz et al. | |
| 2011/0108464 | A1 | 5/2011 | Rankin et al. | |

OTHER PUBLICATIONS

Jain, Suman L., et al. Rehenium-Catalyzed Highly Efficient Oxidations of Tertiary Nitrogen Compounds to N-Oxides Using Sodium Percarbonate as Oxygen Source. Synlett, 2006, No. 16, pp. 2661-2663. Published on Web Sep. 22, 2006.

McKillop, Alexander, et al. Further Functional-Group Oxidations Using Sodium Perborate. Tetrahedron, vol. 45, No. 11, pp. 3299 to 3306, 1989. Published in Great Britain.

Varma, Rajender S., et al. The Urea-Hydrogen Peroxide Complex: Solid-State Oxidative Protocols for Hydroxylated Aldehydes and Ketones (Dakin Reaction), Nitriles, Sulfides, and Nitrogen Heterocycles. Organic Letters, 1999, vol. 1, No. 2, pp. 189-191. Published on Web May 29, 1999.

Jana, Nirmal K., et al. Phase-Vanishing Methodology for Efficient Bromination, Alkylation, Epoxidation, and Oxidation Reactions of Organic Substrates. Organic Letters, 2003, vol. 5, No. 21, pp. 3787-3790. Published on Web Sep. 16, 2003.

Khodaei, Mohammad Mehdi, et al. H2O2/Tf2O System: An Efficient Oxidizing Reagent for Selective Oxidation of Sulfanes. Synthesis, 2008; No. 11, pp. 1682-1684. Published on Web Apr. 11, 2008.

Kim, Sung Soo, et al. A Mild and Highly Efficient Oxidation of Sulfide to Sulfoxides with Periodic Acid Catalyzed by FeCl3. Synthesis, 2002, No. 17, pp. 2484-2486. Published USA Feb. 12, 2002.

Qian, Weixing, et al. Efficient and Highly Selective Oxidation of Sulfides to Sulfoxides in the Presence of an Ionic Liquid Containing Hypervalent Iodine. Synlett, 2006, No. 5, pp. 709-712. Published on Web Mar. 9, 2006.

Matteucci, Mizio, et al. Mild and Highly Chemoselective Oxidation of Thioethers Mediated by Sc(OTf)3. Organic Letters, 2003, vol. 5, No. 3, 235-237. Published on Web Jan. 11, 2003.

Mba, Myriam, et al. C3-Symmetric Ti(IV) Triphenolate Amino Complexes as Sulfoxidation Catalysts with Aqueous Hydrogen Peroxide. Organic Letters, 2007, vol. 9, No. 1, pp. 21-24. Published on Web Dec. 9, 2006.

Drago, Carmelo, et al. Vanadium-Catalyzed Sulfur Oxidation/Kinetic Resolution in the Synthesis of Enantiomerically Pure Alkyl Aryl Sulfoxides. Agnew. Chem. Int. Ed, 2005, 44, pp. 7221-7223. Published on Web Oct. 17, 2005.

Egami, Hiromichi, et al. Fe(salan)-Catalyzed Asymmetric Oxidation of Sulfides with Hydrogen Peroxide in Water. J. Am. Chem. Soc., 2007, vol. 129, No. 29, pp. 8940-8941. Published on Web Jun. 29, 2007.

Sun, Jiangtao, et al. Efficient Asymmetric Oxidation of Sulfides and Kinetic Resolution of Sulfoxides Catalyzed by a Vanadium-Salan System. J. Org. Chem., 2004, vol. 69, No. 24, pp. 8500-8503. Published on Web Oct. 28, 2004.

Karimi, Babak, et al. Selective Oxidation of Sulfides to Sulfoxides Using 30% Hydrogen Peroxide Catalyzed with a Recoverable Silica-Based Tungstate Interphase Catalyst. Organic Letters, 2005, vol. 7, No. 4, pp. 625-628. Published on Web Jan. 25, 2005.

Ali, Mohammed Hashmat, et al. Ceric Ammonium Nitrate Catalyzed Oxidation of Sulfides to Sulfoxides. Synthesis, 2007, No. 22, pp. 3507-3511. Published on Web Oct. 16, 2007.

Imada, Yasushi, et al. Flavin Catalyzed Oxidations of Sulfides and Amines with Molecular Oxygen. J. Am Chem. Soc., 2003, vol. 125, No. 10, pp. 2868-2869. Published on Web Feb. 12, 2003.

Varma, Rajender S., et al. The Urea-Hydrogen Peroxide Complex: Solid-State Oxidatives Protocols for Hydroxylated Aldehydes and Ketones (Dakin Reaction), Nitriles, Sulfides, and Nitrogen Heterocycles. Organic Letters, 1999, vol. 1, No. 2, pp. 189-191. Published on Web May 29, 1999.

Jana, Nirmal K.,e t al. Phase-Vanishing Methodology for Efficient Bromination, Alkylation, Epoxidation, and Oxidation Reactions of Organic Substrates. Organic Letters, 2003, vol. 5, No. 21, pp. 3787-3790. Published on Web Sep. 16, 2003.

Shaabani, Ahmad, et al. Green oxidations. The use of potassium permanganate supported on manganese dioxide. Tetrahedron, 2004, 60, pp. 11415-11420. Published on Web Oct. 12, 2004.

Wozniak, Lucyna A., et al. Oxidation in Organophosphorus Chemistry: Potassium Peroxymonosulphate. Tetrahedron, 1999, 40, pp. 2637-2640. Accepted Feb. 3, 1999. No published date.

Akasaka, Takeshi,e t al. Singlet Oxygen Oxidation of Organophosphorus Compounds: Cooxidation of Olefin with Phosphadioxirane. Quimica Nova, 1993, 16, pp. 325-327. No published date or location.

Milner, O.I., et al. Determination of Trace Materials in Crudes and Other Petroleum Oils. Analytical Chemistry, vol. 24, No. 11. Published Nov. 1952, USA.

Aida, Tetsuo, et al. Development of an Efficient Coal-Desulfurization process: "Oxy-Alkalinolysis". Technical Report Resource Conference: American Chemical Society symposium on coal liquefaction, pp. 328-334. Kansas City, MO USA. Published Sep. 1, 1982 Ames Lab., IA (USA); Advanced Fuel Research, Inc., East Hartford, CT (USA).

Aida, Tetsuo, et al. Reaction of Dibenzothiophene Sulfone with Alkoxides. Tetrahedron Letters (1983), vol. 24, No. 34, pp. 3543-3546. USA.

Oviedo, Alberto, et al. Deoxydesulfurization of sulfones derived from dibenzothiophene using nickel compounds. Journal of Molecular Catalysis A: Chemical, (2008) 293, pp. 65-71. USA.

U.S. Appl. No. 12/933,898, filed Sep. 22, 2010; Confirmation No. 2836; Customer No. 5409.

U.S. Appl. No. 12/888,049, filed Sep. 22, 2010; Confirmation No. 3666; Customer No. 5409.

Application No. PCT/US11/50159, International Search Report and the Written Opinion of the International Searching Authority dated Jan. 12, 2012. 11 pages.

International Search Report and Written Opinion; PCT/US11/54840; Auterra, Inc.; Int'l File Date: Oct. 5, 2011; Priority Date: Oct. 14, 2010; 8 pages.

* cited by examiner

METHODS FOR UPGRADING OF CONTAMINATED HYDROCARBON STREAMS

CROSS-REFERENCE TO RELATED APPLICATIONS

This application is a continuation in part of Ser. No. 12/933,898, filed Sep. 22, 2010, entitled Sulfoxidation Catalysts and Method of Using the Same), which claims priority under 35 USC 371 based upon PCT/US08/82095 filed Oct. 31, 2008, entitled Sulfoxidation Catalysts and Method of Using the Same), which claims priority to provisional patent application 61/039,619 filed Mar. 26, 2008, entitled Sulfoxidation Catalysts and Method of Using the Same); and this application is a continuation in part of Ser. No. 12/888,049, filed Sep. 22, 2010, entitled Reaction System and Products Therefrom, the disclosure of each is hereby incorporated by reference to the extent not inconsistent with the present disclosure.

BACKGROUND

The present disclosure is directed to systems and methods for upgrading crude oil, refinery intermediate streams, and refinery products to substantially decrease the content of undesired heteroatom contaminants, including, but not limited to, sulfur, nitrogen, phosphorus, nickel, vanadium, iron, with the added benefit of decreasing the total acid number and increasing the API gravity. A heteroatom contaminated hydrocarbon feed stream is subjected to heteroatom oxidizing conditions to produce an oxidized-heteroatom-containing hydrocarbon intermediate stream and then contacting said stream with a selectivity promoter and caustic thereby removing the heteroatom contaminants from the hydrocarbon stream and thereby increasing the API gravity and decreasing the total acid number relative to the initial contaminated hydrocarbon feed stream.

As is well known in the industry, crude oil contains heteroatom contaminants including, but not limited to, sulfur, nitrogen, phosphorus, nickel, vanadium, and iron and acidic oxygenates in quantities that negatively impact the refinery processing of the crude oil fractions. Light crude oils or condensates contain heteroatoms in concentrations as low as 0.001 wt %. In contrast, heavy crude oils contain heteroatoms as high as 5-7 wt %. The heteroatom content of crude oil increases with increasing boiling point and the heteroatom content increases with decreasing API gravity. These contaminants must be removed during refining operations to meet the environmental regulations for the final product specifications (e.g., gasoline, diesel, fuel oil) or to prevent the contaminants from decreasing catalyst activity, selectivity, and lifetime in downstream refining operations. Contaminants such as sulfur, nitrogen, phosphorus, nickel, vanadium, iron, and total acid number (TAN) in the crude oil fractions negatively impact these downstream processes, and others, including hydrotreating, hydrocracking and FCC to name just a few. These contaminants are present in the crude oil fractions in various organic hydrocarbon molecules and in various concentrations.

Sulfur is widely recognized as the most egregious heteroatom contaminant as a result of the environmental hazard caused by its release into the environment after combustion. It is believed, sulfur oxides from combustion (known collectively as $SO_x$ emissions) contribute to the formation of acid rain and also to the reduction of the efficiency of catalytic converters in automobiles. Furthermore, sulfur compounds are thought to ultimately increase the particulate content of combustion products. Nitrogen, phosphorus, and other heteroatom contaminants present similar environmental risks.

A variety of methods have been implemented for removing sulfur compounds either from fuels before combustion or from emission gases afterward. Most refineries employ hydrodesulfurization (HDS) as the predominant process for removing sulfur from hydrocarbon streams. HDS remains a cost-effective option for light streams with sulfur levels up to about 2% (w/w) elemental sulfur, but the environmental and economic benefits of HDS are offset in very heavy and sour (>2% elemental sulfur) streams because the energy input to the reaction, the high pressures and the amount of hydrogen necessary to remove the sulfur paradoxically create a substantial $CO_2$ emission problem.

Because of these issues, reduction of contaminants and, in particular, of the sulfur content in hydrocarbon streams has become a major objective of environmental legislation worldwide. Sulfur is regulated in the United States for on-road diesel at a maximum concentration of 15 ppm. By October 2012, sulfur specifications will be 15 ppm for non-road, locomotive, and marine diesel fuel. In the European Union that specification is expected to tighten to 10 ppm in January 2011 for diesels intended for inland waterways and for on-road and off-road diesel operated equipment. In China, the on-road diesel specification will be 10 ppm by 2012. Currently the tightest specifications in the world are in Japan, where the on-road diesel specification is 10 ppm.

Refiners typically use catalytic hydrodesulfurizing ("HDS", commonly referred to as "hydrotreating") methods to lower the sulfur content of hydrocarbon fuels, decrease the total acid number, and increase the API gravity. In HDS, a hydrocarbon stream that is derived from petroleum distillation is treated in a reactor that operates at temperatures ranging between 575 and 750° F. (about 300 to about 400° C.), a hydrogen pressure that ranges between 430 to 14,500 psi (3000 to 10,000 kPa or 30 to 100 atmospheres) and hourly space velocities ranging between 0.5 and 4 $h^{-1}$. Dibenzothiophenes in the feed react with hydrogen when in contact with a catalyst arranged in a fixed bed that comprises metal sulfides from groups VI and VIII (e.g., cobalt and molybdenum sulfides or nickel and molybdenum sulfides) supported on alumina. Because of the operating conditions and the use of hydrogen, these methods can be costly both in capital investment and operating costs.

As is currently known, HDS or hydrotreating may provide a treated product in compliance with the current strict sulfur level targets. However, due to the presence of sterically hindered refractory sulfur compounds such as substituted dibenzothiophenes, the process is not without issues. For example, it is particularly difficult to eliminate traces of sulfur using such catalytic processes when the sulfur is contained in molecules such as dibenzothiophene with alkyl substituents in position 4-, or 4- and 6-positions of the parent ring. Attempts to completely convert these species, which are more prevalent in heavier stocks such as diesel fuel and fuel oil, have resulted in increased equipment costs, more frequent catalyst replacements, degradation of product quality due to side reactions, and continued inability to comply with the strictest sulfur requirements for some feeds.

This has prompted many to pursue non-hydrogen alternatives to desulfurization, such as oxydesulfurization. One attempt at solving the problem discussed above includes selectively desulfurizing dibenzothiophenes contained in the hydrocarbon stream by oxidizing the dibenzothiophenes into a sulfone in the presence of an oxidizing agent, followed by optionally separating the sulfone compounds from the rest of the hydrocarbon stream and further reacting the sulfones with a caustic to remove the sulfur moiety from the hydrocarbon fragment.

Oxidation has been found to be beneficial because oxidized sulfur compounds can be removed using a variety of separation processes that rely on the altered chemical properties such as the solubility, volatility, and reactivity of the sulfone compounds. An important consideration in employing oxidation is chemical selectivity. Selective oxidation of sulfur heteroatom moieties without oxidizing the plethora of olefins and benzylic hydrocarbons found in crude oils, refinery intermediates, and refinery products remains a significant challenge. One selective sulfoxidation method and system is disclosed in International Publication Number WO 2009/120238 A1, to Litz et al. The inventors of the present disclosure have further discovered that the catalyst of the above-mentioned international publication number is further capable of oxidizing additional heteroatoms, including, but not limited to nitrogen and phosphorus found as naturally abundant contaminants in crude oils, refinery intermediates, and refinery products as organic heteroatom-containing compounds. FIG. 1 describes a table of available oxidation states for organic heteroatom compounds.

Another concern with heteroatom oxidation lies in the fate of the oxidized organic heteroatom compounds produced. If the oxidized organic heteroatom compounds are hydrotreated, they may be converted back to the original heteroatom compounds thereby regenerating the original problem. The feed heteroatom content may be likely to be in the range of 0% to 10% by weight heteroatom. Heteroatoms, on average, comprise about 15 wt % of substituted and unsubstituted organic heteroatom molecules. Therefore, up to 67 wt % of the oil may be removed as oxidized organic heteroatom extract if not removed from the organic molecules. For a typical refinery processing 40,000 barrels per day of crude oil, up to 27,000 barrels per day of oxidized organic heteroatom oil will be generated, which is believed to be too much to dispose conventionally as a waste product. Further, the disposal of oxidized organic heteroatom oil also wastes valuable hydrocarbons, which could theoretically be recycled if an efficient process were available.

A considerable challenge presented to heteroatom removal remains the removal of the oxidized heteroatom fragment from the oxidized organic heteroatom compounds created by oxidation of the initial organic heteroatom species. Therefore, a need exists for methods and systems for upgrading heteroatom-contaminated hydrocarbon feed streams by removing heteroatom contaminants from hydrocarbon streams with the added benefit of decreasing the total acid number and increasing the API gravity of the resulting product relative to the contaminated hydrocarbon feed stream.

SUMMARY OF THE DISCLOSURE

The present invention relates to a method of upgrading a heteroatom-containing hydrocarbon feed by removing heteroatom contaminants, the method comprising: contacting the heteroatom-containing hydrocarbon feed with an oxidant; contacting the oxidized heteroatom-containing hydrocarbon feed with at least one caustic and at least one selectivity promoter; and removing the heteroatom contaminants from the heteroatom-containing hydrocarbon feed. The oxidant may be used in the presence of a catalyst.

The invention further provides a method of upgrading a heteroatom-containing hydrocarbon feed by removing heteroatom contaminants, the method comprising: contacting the heteroatom-containing hydrocarbon feed with an oxidant to oxidize at least a portion of the heteroatom contaminants to form a first intermediate stream; contacting the first intermediate stream with at least one caustic and at least one selectivity promoter to form a second intermediate stream; separating a substantially heteroatom-free hydrocarbon product from the second intermediate stream; recovering the at least one caustic and at least one selectivity promoter from the second intermediate stream; and recycling the recovered at least one caustic and at least one selectivity promoter.

The invention still further provides a method of upgrading a heteroatom-containing hydrocarbon feed by removing heteroatom contaminants, the method comprising oxidizing dibenzothiophenes to sulfones, reacting the sulfones with caustic and a selectivity promoter, and separating a substantially heteroatom-free hydrocarbon product.

Other features, aspects, and advantages of the present invention will become better understood with reference to the following description.

BRIEF DESCRIPTION OF THE DRAWINGS

The features of the disclosure are set forth in the appended claims. The disclosure itself, however, will be best understood by reference to the following detailed description of illustrative embodiments when read in conjunction with the accompanying drawings, wherein:

DETAILED DESCRIPTION OF THE PRESENTLY PREFERRED EMBODIMENTS

Figure 1:
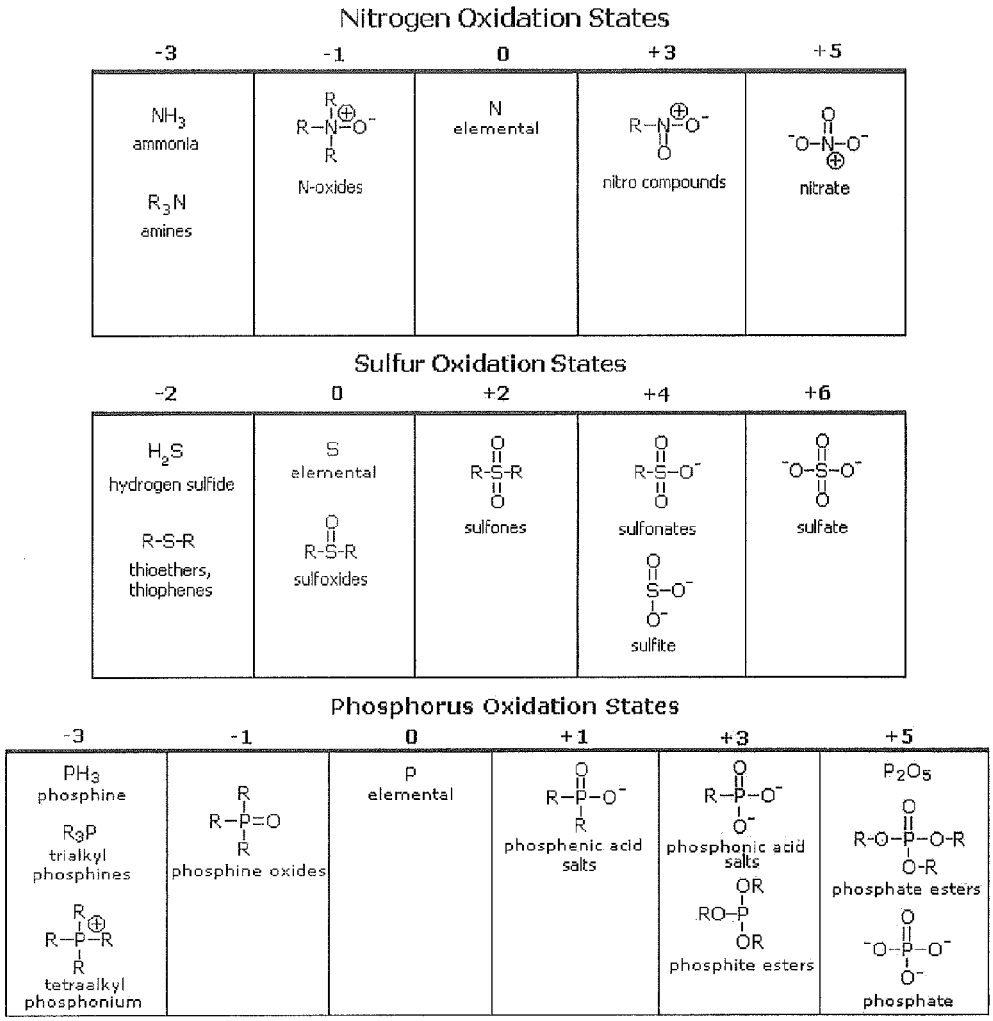
FIG. 1 is a graphic representation of the various oxidation states of certain heteroatoms, in accordance with embodiments of the present disclosure.

While this disclosure contains many specific details, it should be understood that various changes and modifications may be made without departing from the scope of the technology herein described. The scope of the technology shall in no way be construed as being limited to the number of constituting components, the concentration of constituting components, the materials thereof, the shapes thereof, the relative arrangement thereof, the temperature employed, the order of combination of constituents thereof, etc., and are disclosed simply as examples. The depictions and schemes shown herein are intended for illustrative purposes and shall in no way be construed as being limiting in the number of constituting components, connectivity, reaction steps, the materials thereof, the shapes thereof, the relative arrangement thereof, the order of reaction steps thereof, etc., and are disclosed simply as an aid for understanding. The examples described herein relate to the oxidation of heteroatom contaminates in hydrocarbon streams including crude oil, refinery intermediate streams, and refinery products, and they relate to systems and methods for the removal of said oxidized heteroatoms from said hydrocarbon streams.

Unless otherwise indicated, all numbers expressing quantities of ingredients, properties such as molecular weight, reaction conditions, and so forth used in this specification and claims are to be understood as being modified in all instances by the term "about." Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the disclosure are approximations, the numerical values set forth in the specific examples are reported as precisely as possible. Any numerical value, however, inherently contain certain errors necessarily resulting from the standard deviation found in their respective testing measurements.

As used in this application, the term "promoted-caustic visbreaker" means a heated reactor that contains a caustic and a selectivity promoter that react with oxidized heteroatoms to remove sulfur, nickel, vanadium, iron and other heteroatoms, increase API gravity and decrease total acid number.

As used in this application, the term "contaminated hydrocarbon stream" is a mixture of hydrocarbons containing heteroatom constituents. "Heteroatoms" is intended to include all elements other than carbon and hydrogen.

The oxidation reaction may be carried out at a temperature of about 20° C. to about 120° C., at a pressure of about 0.5 atmospheres to about 10 atmospheres, with a contact time of about 2 minutes to about 180 minutes. The oxidant employed may be any oxidant which, optionally in the presence of a catalyst, oxidizes heteroatoms in the heteroatom-containing hydrocarbon feed, for example, but not limited to, hydrogen peroxide, peracetic acid, benzyl hydroperoxide, ethylbenzene hydroperoxide, cumyl hydroperoxide, sodium hypochlorite, oxygen, air, etc, and more presently preferably an oxidant which does not oxidize the heteroatom-free hydrocarbons in the contaminated hydrocarbon feed. Even more preferably, the catalyst employed therein may be any catalyst capable of utilizing an oxidant to oxidize heteroatoms in the heteroatom-containing hydrocarbon feed Suitable catalysts include, but are not limited to, catalyst compositions represented by the formula $M_mO_m(OR)_n$, where M is a metal complex, such as, for example, titanium or any metal, including, but not limited to, rhenium, tungsten or other transition metals alone or in combination that causes the chemical conversion of the sulfur species, as described herein. R is carbon group having at least 3 carbon atoms, where at each occurrence R may individually be a substituted alkyl group containing at least one OH group, a substituted cycloalkyl group containing at least one OH group, a substituted cycloalkylalkyl group containing at least one OH group, a substituted heterocyclyl group containing at least one OH group, or a heterocyclylalkyl containing at least one OH group. The subscripts m and n may each independently be integers between about 1 and about 8. R may be substituted with halogens such as F, Cl, Br, and I. In some embodiments, the metal alkoxide comprises bis(glycerol)oxotitanium(IV)), where M is Ti, m is 1, n is 2, and R is a glycerol group. Other examples of metal alkoxides include bis(ethyleneglycol)oxotitanium (IV), bis(erythritol)oxotitanium (IV), and bis(sorbitol)oxotitanium (IV), as disclosed in International Publication Number WO 2009/120238 A1, to Litz et al.

Other suitable catalysts include, but are not limited to, catalyst compositions prepared by the reaction of Q-R-Q' with a bis(polyol)oxotitanium(IV) catalyst, wherein Q and Q' each independently comprise an isocyanate, anhydride, sulfonyl halide, benzyl halide, carboxylic acid halide, phosphoryl acid halide, silyl chloride, or any chemical functionality capable of reacting with the —OH pendant group of the catalyst, and wherein R comprises a linking group. The R linking group is selected from the group consisting of alkyl groups (including linear, branched, saturated, unsaturated, cyclic, and substituted alkyl groups, and wherein hetero atoms, such as oxygen, nitrogen, sulfur, silicon, phosphorus, and the like can be present in the alkyl group), typically with from 1 to about 22 carbon atoms, preferably with from 1 to about 12 carbon atoms, and more preferably with from 1 to about 7 carbon atoms, although the number of carbon atoms can be outside of these ranges, aryl groups (including substituted aryl groups), typically with from about 6 to about 30 carbon atoms, preferably with from about 6 to about 15 carbon atoms, and more preferably with from about 6 to about 12 carbon atoms, although the number of carbon atoms can be outside of these ranges, arylalkyl groups (including substituted arylalkyl groups), typically with from about 7 to about 30 carbon atoms, preferably with from about 7 to about 15 carbon atoms, and more preferably with from about 7 to about 12 carbon atoms, although the number of carbon atoms can be outside of these ranges, such as benzyl or the like, alkylaryl groups (including substituted alkylaryl groups), typically with from about 7 to about 30 carbon atoms, preferably with from about 7 to about 15 carbon atoms, and more preferably with from about 7 to about 12 carbon atoms, although the number of carbon atoms can be outside of these ranges, silicon or phosphorus, typically with from 1 to about 22 carbon atoms, preferably with from 1 to about 12 carbon atoms, and more preferably with from 1 to about 7 carbon atoms, although the number of carbon atoms can be outside of these ranges, polyalkyleneoxy groups (including substituted polyalkyleneoxy groups), such as polyethyleneoxy groups, polypropyleneoxy groups, polybutyleneoxy groups, and the like, typically with from about 3 to about 60 repeat alkyleneoxy units, preferably with from about 3 to about 30 repeat alkyleneoxy units, and more preferably with from about 3 to about 20 repeat alkyleneoxy units, although the number of repeat alkyleneoxy units can be outside of these ranges, as disclosed in International Publication Number WO 2009/120238 A1, to Litz et al.

The solvent used in extracting the heteroatom-containing hydrocarbon stream after the oxidation reaction (e.g. in a liquid-liquid extractor) may be any solvent with relatively low solubility in oil but relatively high solubility of oxidized heteroatom-containing hydrocarbons, including, but not limited to, acetone, methanol, ethanol, ethyl lactate, N-methylpyrollidone, dimethylacetamide, dimethylformamide, gamma-butyrolactone, dimethyl sulfoxide, propylene carbonate, acetonitrile, acetic acid, sulfuric acid, liquid sulfur dioxide, etc, which is capable of extracting the heteroatoms from the heteroatom containing hydrocarbon stream and producing a substantially heteroatom-free hydrocarbon product.

The promoted-caustic visbreaker reaction may take place at a temperature from about 150° C. to about 350° C., at a pressure from about 0 psig to about 2000 psig, with a contact time from about 2 minutes to about 180 minutes.

The caustic of the present disclosure may be any inorganic compound which may exhibit basic properties including, but not limited to, inorganic oxides from group IA and IIA elements, inorganic hydroxides from group IA and IIA elements, and/or mixtures thereof. Non-limiting examples include, but are not limited to, $Li_2O$, $Na_2O$, $K_2O$, $Rb_2O$, $Cs_2O$, $Fr_2O$, BeO MgO, CaO, SrO, BaO, LiOH, NaOH, KOH, RbOH, CsOH, FrOH, $Be(OH)_2$, $Mg(OH)_2$, $Ca(OH)_2$, $Sr(OH)_2$, $Ba(OH)_2$, and/or mixtures thereof.

In one embodiment of the present invention, the caustic may be in the molten phase. Presently preferred molten phase caustics include, but are not limited to eutectic mixtures of the inorganic hydroxides with melting points less than 350° C., such as, for example, a 51 mole % NaOH/49 mole % KOH eutectic mixture which melts at about 170° C.

In another embodiment of the present invention, the caustic may be supported on an inorganic support, including, but not limited to, oxides, inert or active, such as, for example, a porous support, such as talc or inorganic oxides.

Suitable inorganic oxides include, but are not limited to, oxides of elements of groups IB, II-A and II-B, III-A and II-B, IV-A and IV-B, V-A and V-B, VI-B, of the Periodic Table of the Elements. Examples of oxides preferred as supports include copper oxides, silicon dioxide, aluminum oxide, and/or mixed oxides of copper, silicon and aluminum. Other suitable inorganic oxides which may be used alone or in combination with the abovementioned preferred oxide supports may be, for example, MgO, $ZrO_2$, $TiO_2$, CaO and/or mixtures thereof.

The support materials used may have a specific surface area in the range from 10 to 1000 $m^2/g$, a pore volume in the range from 0.1 to 5 ml/g and a mean particle size of from 0.1 to 10 cm. Preference may be given to supports having a specific surface area in the range from 0.5 to 500 $m^2/g$, a pore volume in the range from 0.5 to 3.5 ml/g and a mean particle size in the range from 0.5 to 3 cm. Particular preference may be given to supports having a specific surface area in the range from 200 to 400 $m^2/g$, and a pore volume in the range from 0.8 to 3.0 ml/g.

The selectivity promoter may be an organic alcohol, ROH, wherein R is a $C_1$-$C_{18}$ alkyl-, aryl-, alkenyl-, substituted alkyl-, or substituted aryl-group that produces non-ionic hydrocarbon products from the oxidized-heteroatom feed. The selectivity promoter may be presently more preferably an alcohol, a diol, or a polyol and mixtures thereof. Non limiting examples include, but are not limited to: methanol, benzyl alcohol, ethylene glycol, propylene glycol, glycerol, pinacol, 1,3-propanediol and the like that may produce non-ionic products from the oxidized-heteroatom feed. Presently more preferred selectivity promoters fall into the class of compounds referred to as vicinal diols, which may have hydroxyl groups bound to adjacent carbon atoms, or the class of alcohols known as primary alcohols, where the hydroxyl group is bound to a carbon atom, that carbon atom being bound to at most one other carbon atom. Presently most preferred may be ethylene glycol or methanol. The non-ionic hydrocarbon product may be substantially insoluble and/or inert to the caustic. Trace quantities of caustic and selectivity promoter may be removed according to known methods by those skilled in the art.

Figure 2:
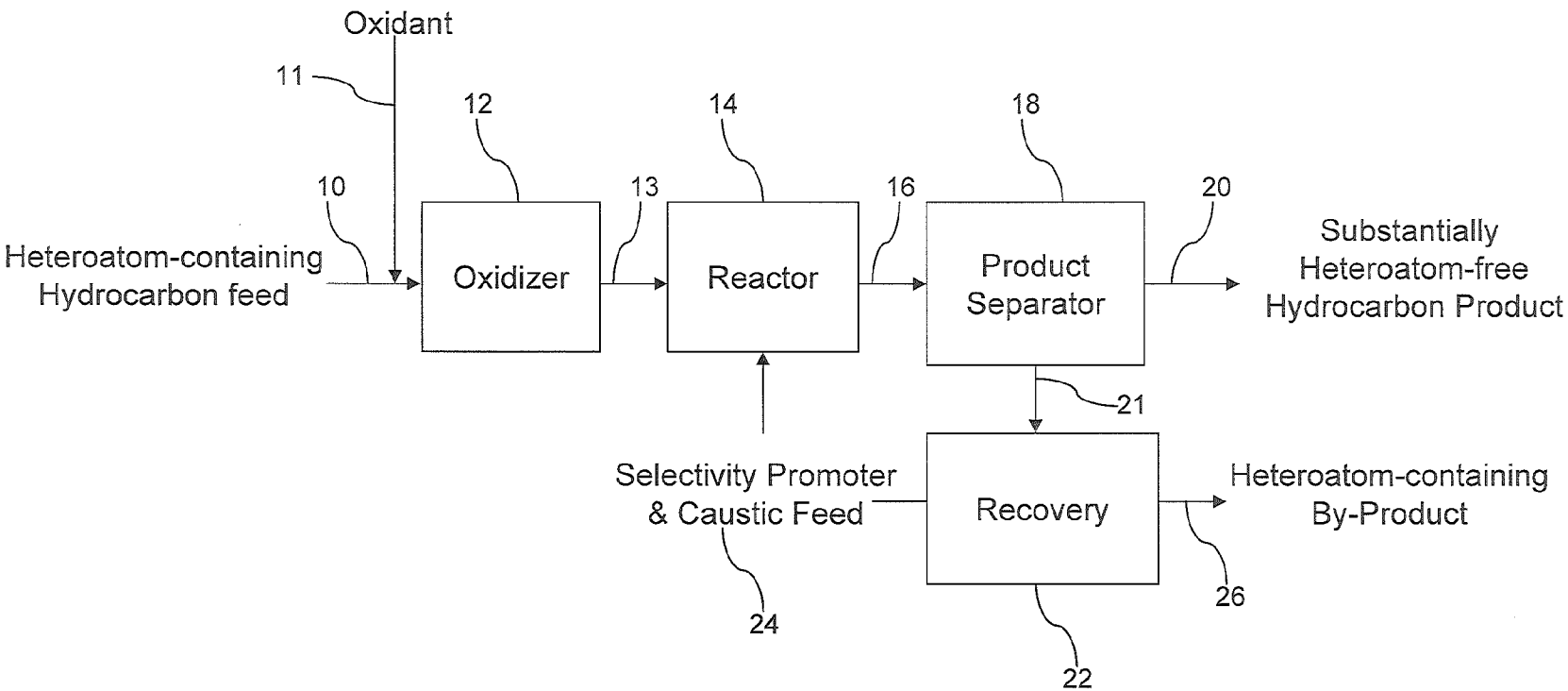
FIG. 2 is a generic process flow diagram of an embodiment of a combination heteroatom oxidation process followed by heteroatom cleavage, in accordance with embodiments of the present disclosure.

As Illustrated in FIG. 2, a heteroatom-containing hydrocarbon feed 10 may be combined with an oxidant 11 and subjected to an oxidizing process in an oxidizer vessel 12 in order to meet current and future environmental standards. The oxidizer vessel 12 may optionally contain a catalyst or promoter (not shown).

After subjecting a hydrocarbon stream to oxidation conditions in oxidizer vessel 12, thereby oxidizing at least a portion of the heteroatom compounds (e.g., oxidizing dibenzothiophenes to sulfones), a first intermediate stream 13 may be generated. The first intermediate stream 13 may be reacted with caustic (e.g., sodium hydroxide, potassium hydroxide, eutectic mixtures thereof etc.) and a selectivity promoter 24 to produce a biphasic second intermediate stream 16.

Second intermediate stream 16 may be transferred to a product separator 18 from which a substantially heteroatom-free hydrocarbon product 20 may be recovered from the light phase. The denser phase 21 containing the selectivity promoter and caustic and heteroatom by-products may be transferred to a recovery vessel 22 in which the selectivity promoter and caustic 24 may be recovered and recycled to reactor 14 and the heteroatom-containing byproduct 26 may be sent to a recovery area for further processing, as would be understood by those skilled in the art.

Figure 3A:
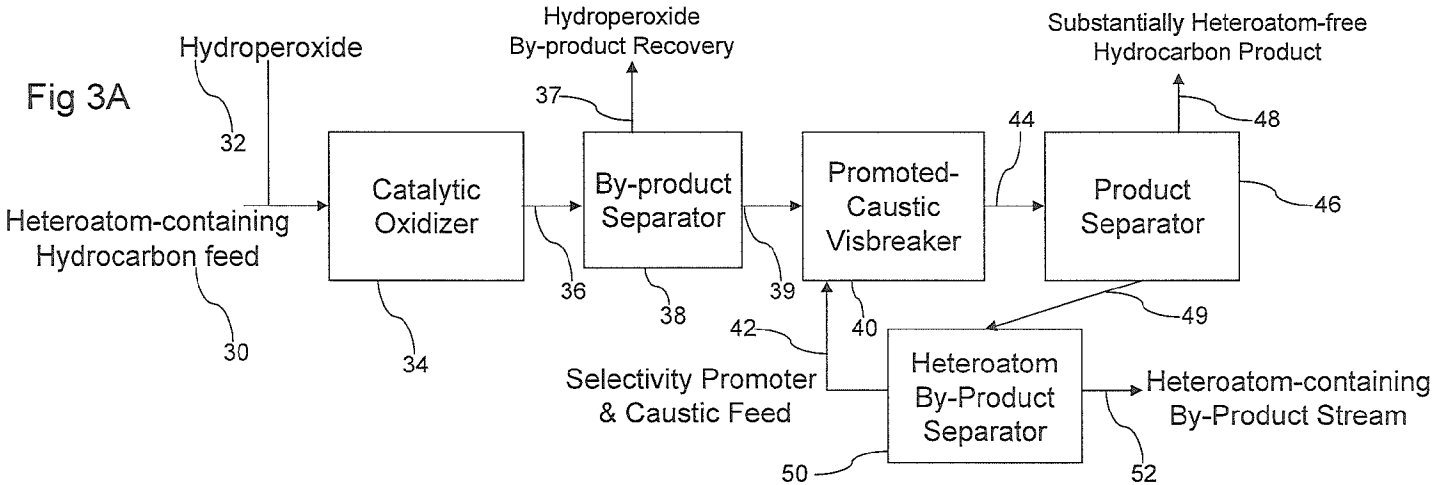
FIG. 3A is a more detailed process flow diagram of an embodiment of a combination heteroatom oxidation process followed by heteroatom cleavage, in accordance with embodiments of the present disclosure.

In a more specific embodiment, as illustrated in FIG. 3A, a heteroatom-containing hydrocarbon feed 30 may be combined with a hydroperoxide 32 in a catalytic oxidizer 34 thereby oxidizing the heteroatoms yielding a first intermediate stream 36. First intermediate stream 36 may be fed to a by-product separator 38 from which the hydroperoxide by-product may be recovered and recycled for reuse in catalytic oxidizer 34 (as would be understood by those skilled in the art) yielding a second intermediate stream 39. The second intermediate stream 39 may be reacted with a selectivity promoter and caustic feed 42 in promoted-caustic visbreaker 40 producing a third intermediate biphasic stream 44 that may be separated in product separator 46 to produce a substantially heteroatom-free hydrocarbon product 48 from the light phase. The dense phase 49 from product separator 46 may be transferred to heteroatom by-product separator 50 from which a heteroatom-containing byproduct stream 52 and selectivity promoter and caustic feed 42 may be independently recovered, as would be known by those skilled in the art.

Figure 3B:
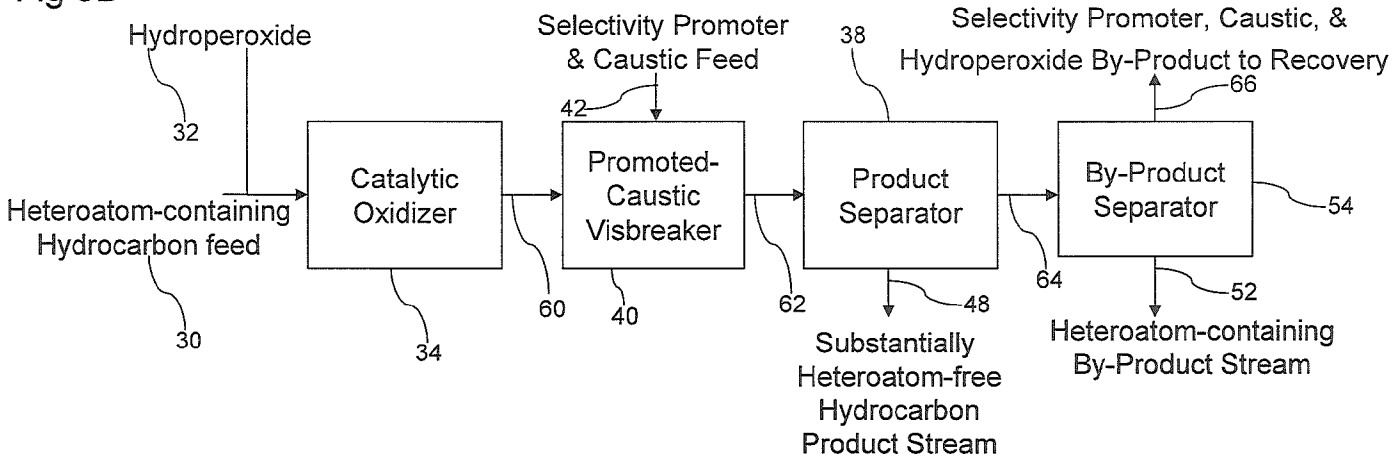
FIG. 3B is an alternative more detailed process flow diagram of an embodiment of a combination heteroatom oxidation process followed by heteroatom cleavage, in accordance with embodiments of the present disclosure.

In still another embodiment, as illustrated in FIG. 3B, the heteroatom-containing hydrocarbon feed 30 may be combined with hydroperoxide 32 and contacted with a catalyst in catalytic oxidizer 34 yielding first intermediate stream 60 which may be transferred to a promoted-caustic visbreaker 40 where it reacts with selectivity promoter and caustic feed 42 producing a biphasic second intermediate stream 62. Second intermediate stream 62 may be transferred to a product separator 38 from which a substantially heteroatom-free hydrocarbon product stream 48 may be removed as the light phase and transported to storage or commercial use. The byproduct separator 54 may separate the dense phase 64 into two streams: a heteroatom-containing by-product stream 52 (which may be transported to storage or commercial use) and a by-product mixture stream 66 containing the selectivity promoter, caustic, and hydroperoxide by-products for recovery and recycle, as would be known by those skilled in the art.

Figure 4:
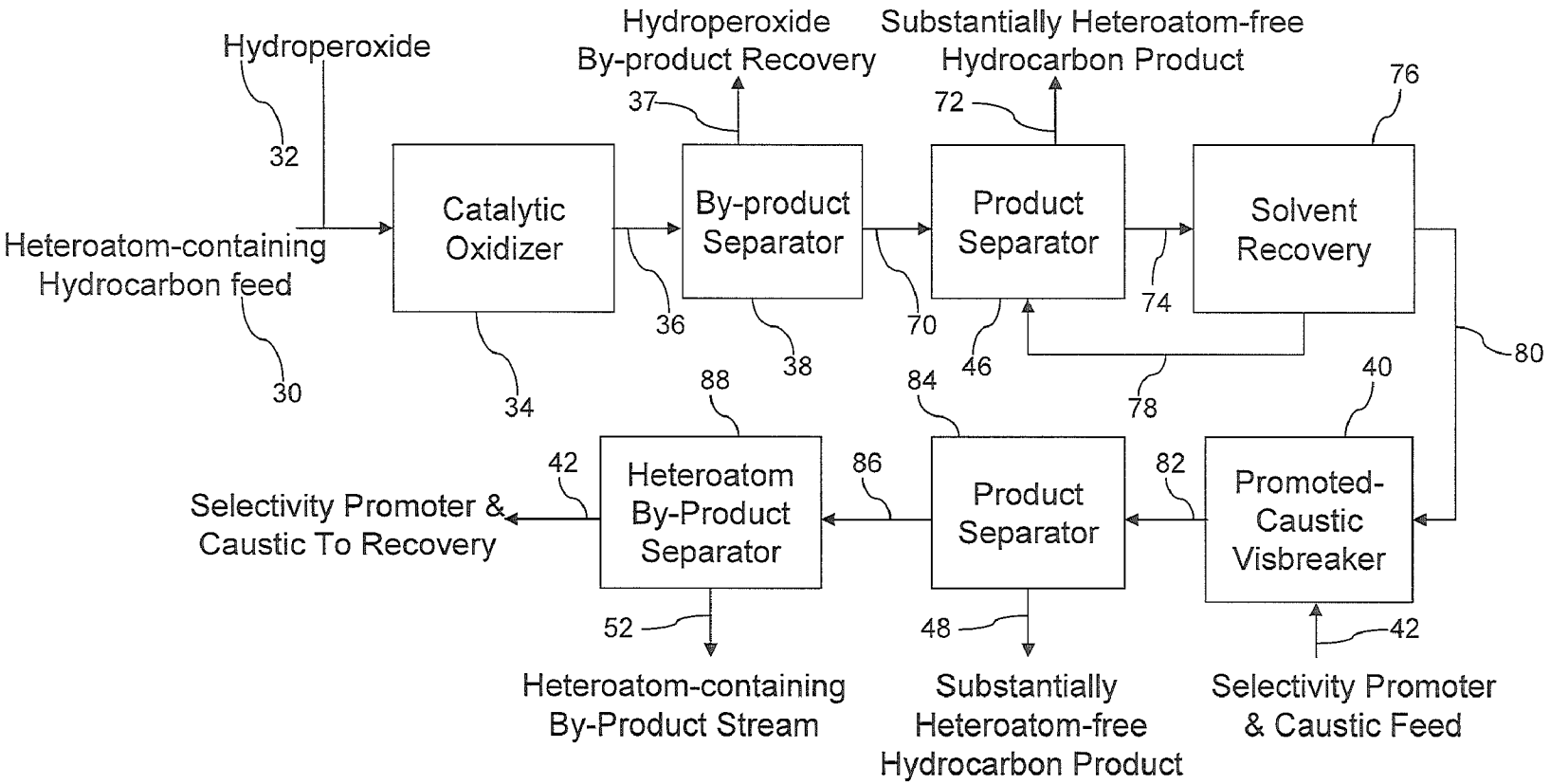
FIG. 4 is an even more detailed process flow diagram of an embodiment of a combination heteroatom oxidation process followed by heteroatom cleavage, in accordance with embodiments of the present disclosure.

In yet another embodiment, as illustrated in FIG. 4, the heteroatom-containing hydrocarbon feed 30 may be mixed with a hydroperoxide feed 32 and may be reacted with a catalyst or promoter (not shown) in the catalytic oxidizer 34 producing a first intermediate stream 36. Stream 36 may be transferred to a by-product separator 38 from which the hydroperoxide by-product 37 may be separated producing a second intermediate stream 70. Stream 70 may be extracted by solvent 78 in product separator 46 (e.g. a liquid-liquid extraction column) from which a substantially heteroatom-free hydrocarbon product 72 may be withdrawn resulting in a third intermediate stream 74. Stream 74 may be fed to solvent recovery 76 from which solvent 78 may be recovered and recycled to product separator 46, producing a fourth intermediate stream 80. Stream 80 may be treated in the promoted-caustic visbreaker 40 containing selectivity promoter and caustic feed 42 producing a biphasic fifth intermediate stream 82. The two phases of stream 82 may be separated in product separator 84 as a light phase 48 and a dense phase 86. The light phase 48 may comprise a substantially heteroatom-free hydrocarbon product that may be shipped to storage or commercial use. The dense phase 86 may be transferred to a heteroatom by-product separator 88 from which a heteroatom-containing byproduct stream 52 may be separated from resulting in a stream 42 containing a selectivity promoter and caustic that may be recovered and recycled for reuse in the promoted-caustic visbreaker 40, as would be understood by those skilled in the art.

Figure 5:
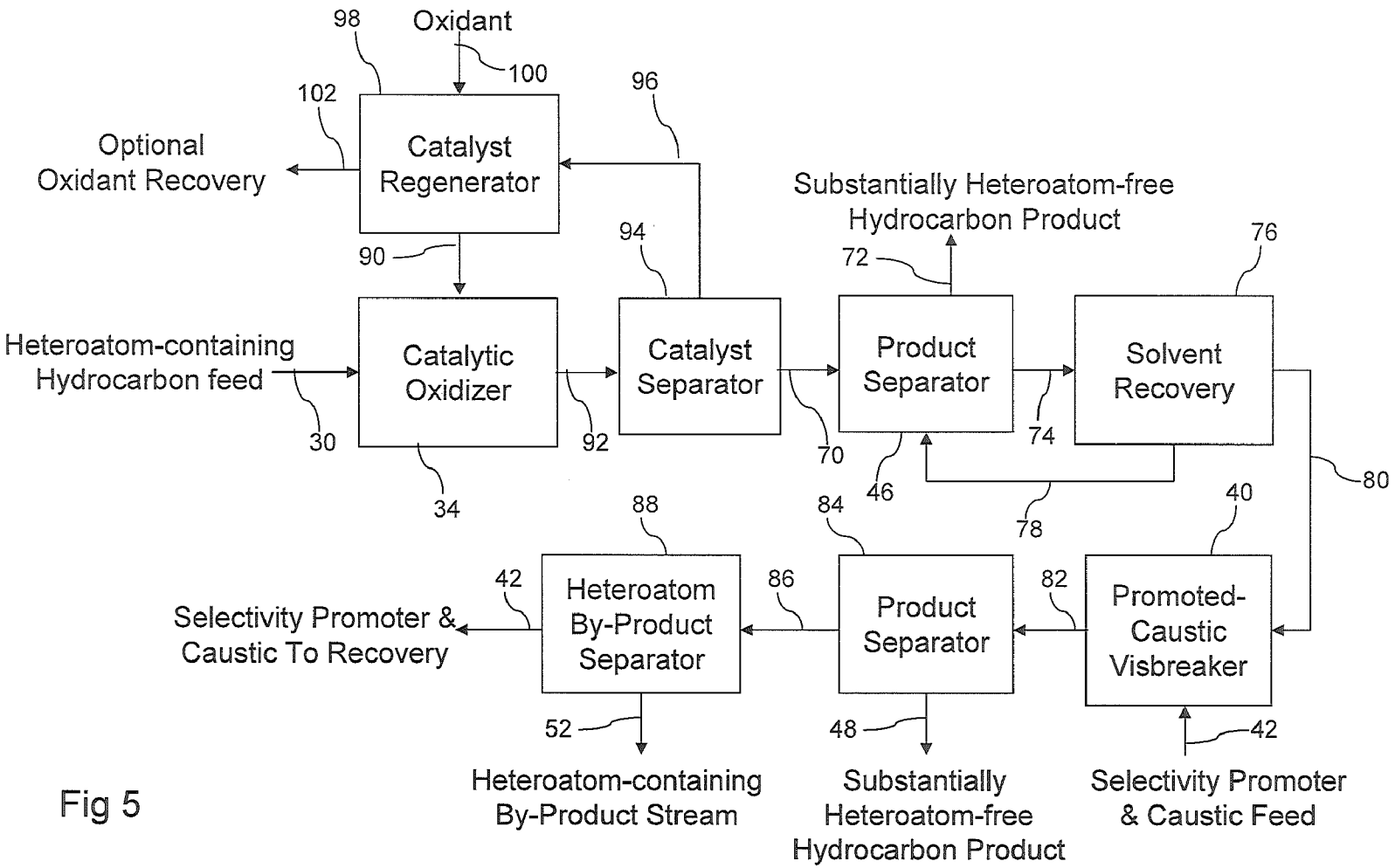
FIG. 5 is an alternative even more detailed process flow diagram of an embodiment of a combination heteroatom oxidation process followed by heteroatom cleavage, in accordance with embodiments of the present disclosure.

In still another embodiment, as illustrated in FIG. 5, the heteroatom-containing hydrocarbon feed 30 may be fed to a catalytic oxidizer 34 where it may be reacted with catalyst stream 90 in the catalytic oxidizer 34 producing a first intermediate stream 92. Stream 92 may be transferred to catalyst separator 94 from which a second intermediate stream 70 and a depleted catalyst stream 96 may be separated. Stream 96 may be fed to catalyst regenerator 98 for regeneration by oxidant feed 100 producing catalyst stream 90 and an oxidant by-product stream 102. Oxidant by-product stream 102 may be optionally recovered, recycled, and reused as would be understood by those skilled in the art. Stream 70 may be extracted by solvent 78 in product separator 46 (e.g. a liquid-liquid extraction column) from which a substantially heteroatom-free hydrocarbon product 72 may be withdrawn resulting in a third intermediate stream 74. Stream 74 may be fed to solvent recovery 76 from which solvent 78 may be recovered and recycled to product separator 46, producing a fourth intermediate stream 80. Stream 80 may be treated in the promoted-caustic visbreaker 40 containing selectivity promoter and caustic feed 42 producing a biphasic fifth intermediate stream 82. The two phases of stream 82 may be separated in product separator 84 as a light phase 48 and a dense phase 86. The light phase 48 may comprise a substantially heteroatom-free hydrocarbon product that may be shipped to storage or commercial use. The dense phase 86 may be transferred to a heteroatom by-product separator 88 from which a heteroatom-containing byproduct stream 52 may be separated from resulting in a stream 42 containing a selectivity promoter and caustic that may be recovered and recycled for reuse in the promoted-caustic visbreaker 40, as would be understood by those skilled in the art.

The following non-limiting examples illustrate certain aspects of the present invention.

EXAMPLES

Example 1

Preparation of Pelletized Polymeric Titanyl Catalyst

A dimethyl sulfoxide (DMSO) solution of co-monomer (e.g. 4,4'-bisphenol A dianhydride (BPADA)) is prepared and is combined with a DMSO solution of the titanyl (e.g. bis (glycerol)oxotitanium(IV)) with stiffing at 70° C. for about 4 hrs to produce a copolymer solution. Then, the solution is cooled to room temperature, and the polymer product is precipitated with excess acetone. The polymeric precipitate is collected by vacuum filtration and is dried. The yield of precipitated polymeric titanyl catalyst is greater than 90%.

A blend of bonding agent (Kynar®), optional inert filler (silica or alumina), and the polymeric titanyl catalyst is prepared in a solid mixer or blender. The blended mixture is then extruded or pelletized by compression producing uniform catalyst pellets with hardness test strength preferably greater than 2 kp.

Example 2

Continuous Catalytic Removal of Heteroatoms from a Heteroatom-Contaminated Light Atmospheric Gas Oil Straight-run light atmospheric gas oil (LAGO) (3.45% sulfur) and cumene hydroperoxide (30% in cumene, fed at a rate of 2.1 mole equivalents to sulfur in LAGO feed) are fed to a fixed bed reactor containing pelletized titanyl polymeric catalyst, prepared in accordance with Example 1, at about 85° C. with a combined LHSV of about 1.0 $hr^{-1}$ producing a first intermediate stream. The first intermediate stream is vacuum distilled at −25 in Hg to remove and recover a low boiling distillate comprising cumene, cumyl alcohol, alpha-methylstyrene, and acetophenone from a heavy second intermediate stream. The heavy second intermediate stream essentially comprises light atmospheric gas oil with oxidized heteroatom compounds. The second intermediate stream is then fed into a heated reactor wherein it combines with a feed stream containing caustic and ethylene glycol (the combined liquid residence time is 1.0 $hr^{-1}$) to produce a biphasic mixture that exits the reactor. The biphasic mixture is then separated by gravity to produce a light phase product comprising essentially heteroatom-free LAGO and a heavy phase by-product stream comprising essentially caustic, ethylene glycol, and heteroatom-containing salts. Sulfur removal from the light phase product is greater than 50%, nitrogen removal is greater than 50%, vanadium removal is greater than 50%, nickel removal is greater than 50%, and iron removal is greater than 50% when the samples are measured for elemental composition and compared against the LAGO feed composition. The heavy phase by-product is further treated according to known methods to recover and recycle the caustic and ethylene glycol from the heteroatom by-products.

The foregoing description of the embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the above described invention.

The invention claimed is:

1. A method of upgrading a heteroatom-containing hydrocarbon feed by removing heteroatom contaminants, the method comprising:

contacting the heteroatom-containing hydrocarbon feed with an oxidant;

contacting the oxidized heteroatom-containing hydrocarbon feed with at least one caustic and at least one selectivity promoter;

removing the heteroatom contaminants from the heteroatom-containing hydrocarbon feed;

wherein contacting with at least one caustic and at least one selectivity promoter is at a temperature in the range from about 150° C. to about 350° C. and at a pressure in the range of from about 0 psig to about 2000 psig; and wherein the selectivity promoter is an organic alcohol, ROH, wherein R is a C1-C18 alkyl-, aryl-, alkenyl-, substituted alkyl-, or substituted aryl-group.

2. The method of claim 1, wherein the at least one caustic is selected from the group consisting of inorganic oxides from group IA and IIA elements, inorganic hydroxides from group IA and IIA elements, and/or mixtures thereof.

3. The method of claim 1, wherein the at least one caustic is in the molten phase.

4. The method of claim 3, wherein the at least one caustic in the molten phase is a eutectic mixture of inorganic hydroxides having a melting point of less than about 350° C.

5. The method of claim 4, wherein the eutectic mixture of inorganic hydroxides is a eutectic mixture of sodium hydroxide and potassium hydroxide.

6. The method of claim 1, wherein the at least one caustic is supported on an inert support.

7. The method of claim 6, wherein the inert support has a specific surface area in the range of from about 10 to about 1000 $m^2/g$, a pore volume in the range of from about 0.1 to about 5 ml/g and a mean particle size in the range of from about 0.1 to about 10 cm.

8. The method of claim 1, wherein the hydrocarbon feed is contacted with the oxidant at a temperature in the range of about 20° C. to about 90° C. and a pressure in the range of about 0.5 atmospheres to about 10 atmospheres.

9. The method of claim 1, wherein the oxidant is selected from the group consisting of hydrogen peroxide, peracetic acid, benzyl hydroperoxide, ethylbenzene hydroperoxide, cumyl hydroperoxide, sodium hypochlorite, oxygen, air, and/or mixtures thereof.

10. The method of claim 1, wherein the oxidized heteroatom-containing hydrocarbon containing feed is extracted by solvent prior to contacting with the at least one caustic and the at least one selectivity promoter.

11. The method of claim 10, wherein the solvent used for extraction is selected from the group consisting of acetone, methanol, ethanol, ethyl lactate, N-methylpyrollidone, dimethylacetamide, dimethylformamide, gamma-butyrolactone, dimethyl sulfoxide, propylene carbonate, acetonitrile, acetic acid, sulfuric acid, liquid sulfur dioxide, and/or mixtures thereof.

12. The method of claim 1, wherein the oxidant is used in the presence of a catalyst.

13. The method of claim 12, wherein the catalyst comprises a metal compound represented by the general formula $M_mO_m(OR)_n$, wherein M is a metal; R is carbon group having at least 3 carbon atoms, where at each occurrence R is selected from the group consisting of a substituted alkyl group containing at least one OH group, a substituted cycloalkyl group containing at least one OH group, a substituted cycloalkylalkyl group containing at least one OH group, a substituted heterocyclyl group containing at least one OH group, and/or a heterocyclylalkyl containing at least one OH group; and subscripts m and n are each independently integers between about 1 and about 8.

14. The method of claim 13, wherein the catalyst comprises bis(polyol)oxotitanium(IV).

15. The method of claim 13, wherein the catalyst comprises bis(glycerol)oxotitanium(IV).

16. The method of claim 12, wherein the catalyst is prepared by the reaction of Q-R-Q' with a bis(polyol)oxotitanium(IV) catalyst, wherein Q and Q' each independently comprise an isocyanate, anhydride, sulfonyl halide, benzyl halide, carboxylic acid halide, phosphoryl acid halide, silyl chloride, or any chemical functionality capable of reacting with the —OH pendant group of the catalyst, and wherein R comprises a linking group.

17. A method of upgrading a heteroatom-containing hydrocarbon feed by removing heteroatom contaminants, the method comprising:

contacting the heteroatom-containing hydrocarbon feed with an oxidant to oxidize at least a portion of the heteroatom contaminants to form a first intermediate stream;

contacting the first intermediate stream with at least one caustic and at least one selectivity promoter to form a second intermediate stream;

separating a substantially heteroatom-free hydrocarbon product from the second intermediate stream;

recovering the at least one caustic and at least one selectivity promoter from the second intermediate stream; and recycling the recovered at least one caustic and at least one selectivity promoter;

wherein contacting with at least one caustic and at least one selectivity promoter is at a temperature in the range from about 150° C. to about 350° C. and at a pressure in the range of from about 0 psig to about 2000 psig; and wherein the selectivity promoter is an organic alcohol, ROH, wherein R is a C1-C18 alkyl-, aryl-, alkenyl-, substituted alkyl-, or substituted aryl-group promoter.

18. A method of upgrading a heteroatom-containing hydrocarbon feed by removing heteroatom contaminants, the method comprising oxidizing dibenzothiophenes to sulfones, reacting the sulfones with caustic and a selectivity promoter, and separating a substantially heteroatom-free hydrocarbon product;

wherein contacting with at least one caustic and at least one selectivity promoter is at a temperature in the range from about 150° C. to about 350° C. and at a pressure in the range of from about 0 psig to about 2000 psig; and wherein the selectivity promoter is an organic alcohol, ROH, wherein R is a C1-C18 alkyl-, aryl-, alkenyl-, substituted alkyl-, or substituted aryl-group promoter.

* * * * *